United States Patent [19]

Youngman

[11] 4,008,879

[45] Feb. 22, 1977

[54] CARPET STRETCHER

[76] Inventor: David R. Youngman, 39 E. Ravenwood Ave., Youngstown, Ohio 44507

[22] Filed: Mar. 4, 1976

[21] Appl. No.: 663,850

[52] U.S. Cl. ..... 254/57

[51] Int. Cl.[2] ..... A47G 27/04

[58] Field of Search ..... 254/57, 93 R

[56] References Cited

UNITED STATES PATENTS

| | | | |
|---|---|---|---|
| 2,882,642 | 4/1959 | Hill | 254/57 |
| 3,311,347 | 3/1967 | Thompson | 254/57 |
| 3,545,250 | 12/1970 | Jones | 254/93 R |

*Primary Examiner*—Al Lawrence Smith
*Assistant Examiner*—Robert C. Watson
*Attorney, Agent, or Firm*—Webster B. Harpman

[57] ABSTRACT

A carpet stretcher arranged for pneumatic actuation in stretching residential and commercial carpet at the time of installation includes an elongated frame and a plurality of movable pneumatic cylinder mounts thereon and at least one pneumatic cylinder and an attached right angular telescopic leg having a foot with carpet engaging means therein on its outermost end. A pair of the pneumatic cylinders and telescopic legs positioned on the frame in oppositely disposed relation act to stretch the carpet and hold the same while it is secured at its edges as customary in the carpet installation art.

6 Claims, 5 Drawing Figures

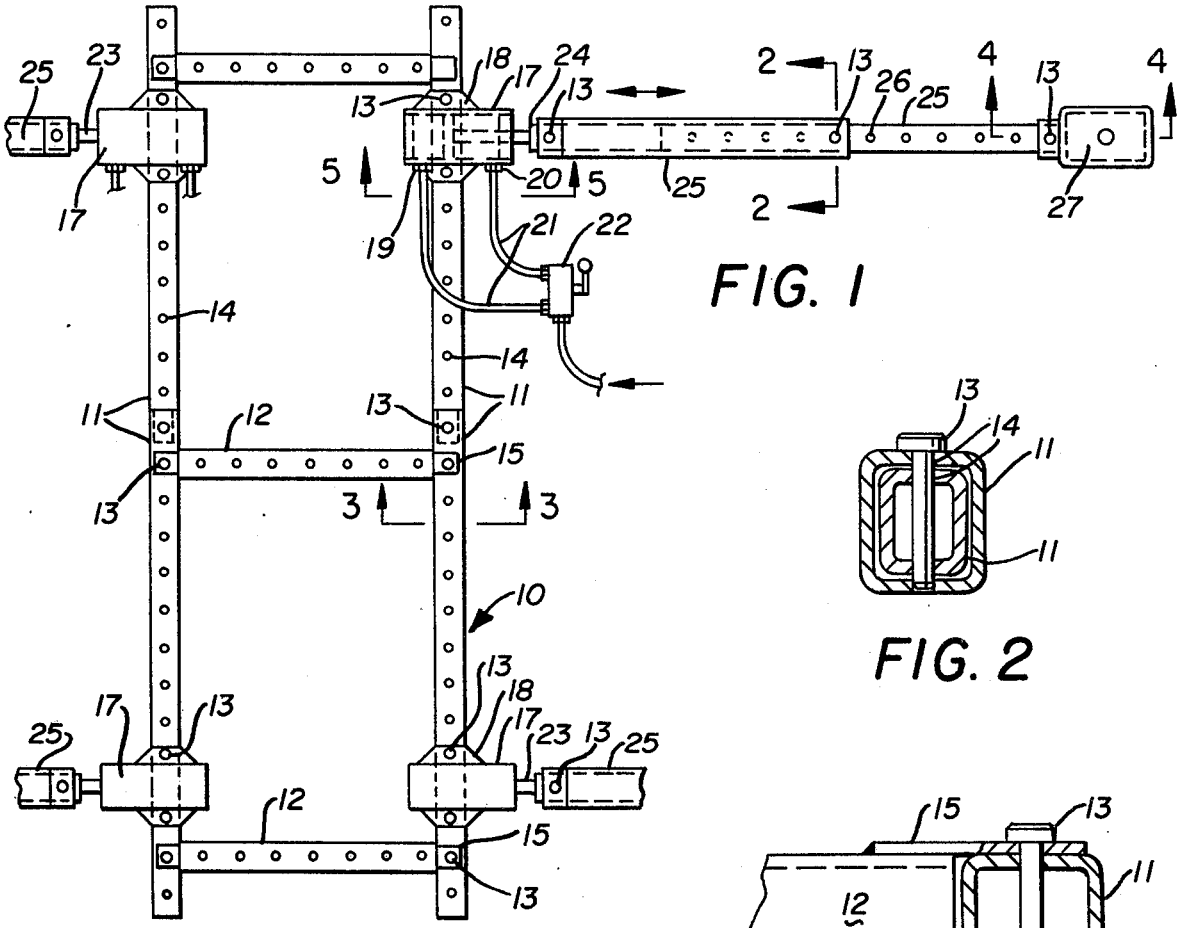
FIG. 1
FIG. 2
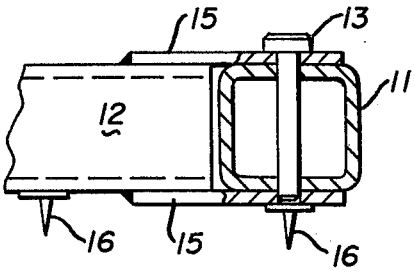
FIG. 3
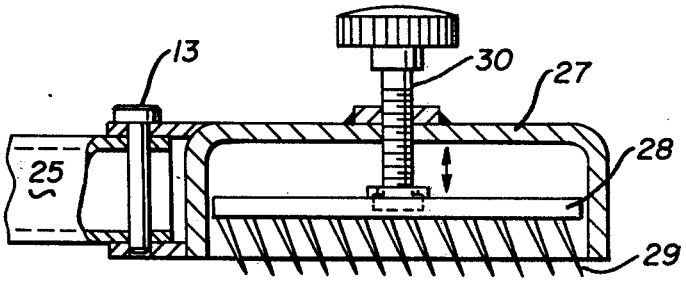
FIG. 4
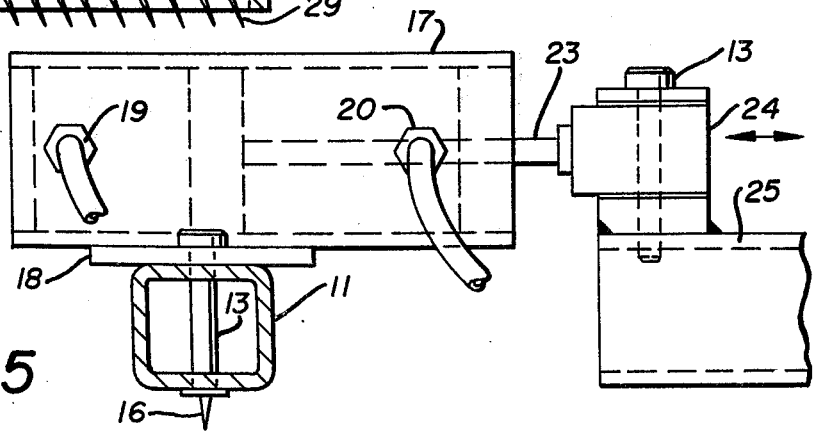
FIG. 5

CARPET STRETCHER

BACKGROUND OF THE INVENTION

1. Field of the Invention

This invention relates to a carpet stretching device such as used to stretch commercial and residential carpet at the time of installation.

2. Description of the Prior Art

Prior devices include those wherein telescopic members are positioned across an area in which a carpet is being installed, the carpet having been secured along one edge in the area and the telescopic device extending from a wall or other support adjacent the secured edge of the carpet to a point adjacent the opposite edge. A foot on the telescopic device engages the carpet and a lever and ratchet mechanism is used to extend the device and thereby stretch the carpet and hold it while it is secured in stretched position. See U.S. Pat. Nos. 3,311,347 and 3,784,078.

This invention introduces a frame which is positioned centrally of the section of carpet being installed and provides for pneumatically operated telescopically arranged oppositely disposed arms for simultaneously stretching the carpet toward both of its edges or alternately toward one of its edges when the frame is provided with carpet engaging means so as to be self-anchoring with respect thereto.

SUMMARY OF THE INVENTION

A carpet stretcher comprises an elongated frame having spaced ladder-like rails and cross members therebetween detachably secured to one another and one or more pneumatic cylinders detachably positioned on the ladder-like rails in any one of a number of positions thereon, the cylinders being connected to telescopic legs, each of which are provided with a carpet engaging foot on its outermost end. Carpet engaging means are preferably positioned on the elongated frame so that the frame and a single telescopic leg and pneumatic cylinder may be operated to stretch the carpet in one area or alternately a pair of such cylinders and legs in opposed relation may be employed or additional cylinders and legs simultaneously employed if desired.

DESCRIPTION OF THE DRAWINGS

FIG. 1 is a top plan view of the carpet stretcher with parts broken away;

FIG. 2 is an enlarged cross sectional detail on line 2—2 of FIG. 1;

FIG. 3 is an enlarged cross sectional detail on line 3—3 of FIG. 1;

FIG. 4 is an enlarged cross sectional detail on line 4—4 of FIG. 1; and

FIG. 5 is an enlarged cross sectional detail on line 5—5 of FIG. 1.

DESCRIPTION OF THE PREFERRED EMBODIMENT

In the form of the invention chosen for illustration herein as seen in FIG. 1, it comprises an elongated frame generally indicated by the numeral 10 and formed of a plurality of ladder-like rails 11 and a plurality of detachably connected cross members 12. The rails 11 are secured to one another in end to end relation by fasteners 13 engaging registering apertures 14 in the rails 11 as seen in FIG. 2 of the drawings and by referring to FIG. 3 of the drawings it will be seen that the ends of the cross members 12 are provided with length wise extensions 15 which are also apertured so that additional fasteners 13 can be engaged therein to secure the cross members 12 to the rails 11.

The rails 11 and the cross members 12 are preferably provided with points 16 in depending relation thereto so that the elongated frame 10 is self-anchoring with respect to its positioning on a section of carpet to be stretched.

By referring now to FIGS. 1 and 5 of the drawings it will be seen that there are a plurality of pairs of pneumatic cylinders 17 illustrated, each of which is secured to an apertured mounting bracket 18 which is in turn removably affixed to one of the rails 11 by fasteners 13. Inlet and outlet ports 19 and 20 are provided on each of the pneumatic cylinders 17 and flexible hoses 21 communicate therewith and with a valve 22 which in turn communicates with a source of compressed air such as a compressed gas cylinder or the like. Each of the pneumatic cylinders 17 has a piston therein and a piston rod 23 extending outwardly thereof and engaged on a coupling 24 which in turn is detachably secured to one end of a telescopic leg 25 as by fasteners 13.

As seen in FIG. 1 of the drawings, the telescopic leg 25 has one or more tubular sections, each of which is provided with registering apertures 26 so that the sections of the leg 25 can be secured to one another in desired lengthwise adjustment.

By referring now to FIGS. 1 and 4 of the drawings, it will be seen that the outermost one of the leg sections 25 is provided with a foot 27 detachably secured thereto as by fasteners 13 engaging registering apertures therein and that the foot 27 includes a vertically adjustable plate 28 which is provided with a plurality of angularly disposed secondary points 29. The plate 28 and the secondary points 29 are movable vertically relative to the foot 27 by means of an adjustment bolt 30 which threadably engages the foot 27 and rotatably engages the plate 28.

It will thus be seen that when the carpet stretcher disclosed herein is positioned on a section of carpet in a room in which the carpet is to be stretched and installed, the elongated frame 10 of the device is positioned generally centrally of the piece of carpet and one or more of the telescopic legs 25 is assembled and provided with the feet 27 and secured to the pneumatic cylinders 17 which in turn are positioned on the elongated frame 10. Preferably opposed pairs of the cylinders 17 and telescopic legs 25 are employed so that the carpet can be stretched away from the opposite sides of the longitudinal frame 10 and toward the edges of the room where the edges are fastened by tacks or tackless mounting strips as will be understood by those skilled in the art. Alternately the frame 10 can be positioned adjacent one side of a piece of carpet and in self-anchoring relation thereto by the points 16 thereon and one or more of the adjustable telescopic legs 25 assembled and extended outwardly from one side thereof toward the opposite edge of the carpet. Actuation of the pneumatic cylinders 17 in either case will effect the necessary stretching and hold the carpet stretched while it is secured along its edges.

It will thus be seen that a carpet stretcher has been disclosed which eliminates injury to the carpet installer as has heretofore been common in the art where the stretching devices are bumped by the knee of the carpet installer in stretching the carpet toward its point of attachment to the floor.

Additionally the present invention avoids the manual effort necessary and wall damage as occurs periodically when carpets are stretched by the prior art devices.

Although but one embodiment of the present invention has been illustrated and described, it will be apparent to those skilled in the art that various changes and modifications may be made therein without departing from the spirit of the invention and having thus described my invention what I claim is.

1. A carpet stretcher comprising a pair of spaced ladder-like rails, cross members joining said rails to form an elongated frame having a plurality of apertures therein, carpet engaging points on said rails, at least one pneumatic piston and cylinder assembly and means detachably mounting said piston and cylinder assembly on one of said rails of said frame at right angles thereto, at least one telescopic leg detachably secured to the piston of the pneumatic piston and cylinder assembly and a foot on the other end of said telescopic leg and means on said foot for engagement with said carpet so that actuation of the pneumatic piston and cylinder will move the foot and the carpet engaged thereby relative to said frame.

2. The carpet stretcher set forth in claim 1 and wherein the ladder-like rails and the cross members comprise a plurality of detachable members, some of which are engaged in end to end relation to form the ladder-like rails and others of which are positioned to form said cross members.

3. The carpet stretcher set forth in claim 1 and wherein said foot on said telescopic leg includes adjustable points for anchoring engagement in a carpet to be stretched.

4. The carpet stretcher set forth in claim 1 and wherein said frame is elongated relative to its width and the apertures are longitudinally spaced with respect to one another and said means detachably mounting said piston and cylinder assembly comprises a mounting bracket on said piston and cylinder assembly and fasteners on said bracket engaging some of said spaced apertures.

5. The carpet stretcher set forth in claim 4 and wherein said frame and leg are formed of sections of cross sectionally square tubing with apertures extending therethrough and the fasteners are removable pins.

6. The carpet stretcher set forth in claim 4 and wherein the piston and cylinder assembly is double acting.

* * * * *